United States Patent [19]

Gilbert et al.

[11] 4,192,147

[45] Mar. 11, 1980

[54] ARRANGEMENTS FOR THE CONTROLLED INJECTION OF CRYOGENIC FLUID

[75] Inventors: Ghislain Gilbert, Bures-sur-Yvette; Gerard Bentz, Elancourt-Trappes; Jean Galey, Voisins Bretonneux, all of France

[73] Assignee: L'Air Liquide, Societe Anonyme pour l'Etude et l'Exploitation des Procedes Georges Claude, Paris, France

[21] Appl. No.: 920,678

[22] Filed: Jun. 30, 1978

[30] Foreign Application Priority Data

Jul. 5, 1977 [FR] France ..... 77 20553

[51] Int. Cl.[2] ..... F17C 7/02

[52] U.S. Cl. ..... 62/49; 73/295; 137/392

[58] Field of Search ..... 62/49, 55; 137/392; 73/295

[56] References Cited

U.S. PATENT DOCUMENTS

| | | | |
|---|---|---|---|
| 3,262,280 | 7/1966 | Chaney | 62/49 |
| 3,633,372 | 1/1972 | Kimmel et al. | 62/49 |
| 3,938,347 | 2/1976 | Riedel et al. | 62/49 |
| 4,059,424 | 11/1977 | Bentz | 62/49 |

FOREIGN PATENT DOCUMENTS

| | | |
|---|---|---|
| 1460017 | 10/1966 | France . |
| 2306935 | 5/1976 | France . |
| 2302479 | 9/1977 | France . |

*Primary Examiner*—Ronald C. Capossela
*Attorney, Agent, or Firm*—Lee C. Robinson, Jr.

[57] ABSTRACT

This invention relates to an arrangement for the automatic distribution in free air of metered quantities of the liquid phase of a cryogenic fluid, and comprises a container to hold the liquid phase, a system to control the supply to the said container, metering means, forced discharge means, means for distributing the cryogenic liquid, and a system for controlling the said metering member and the said discharge means.

The invention is applicable in particular to the casting of metals, to the production of articles formed from different metals, and to the moulding of articles in series.

14 Claims, 1 Drawing Figure

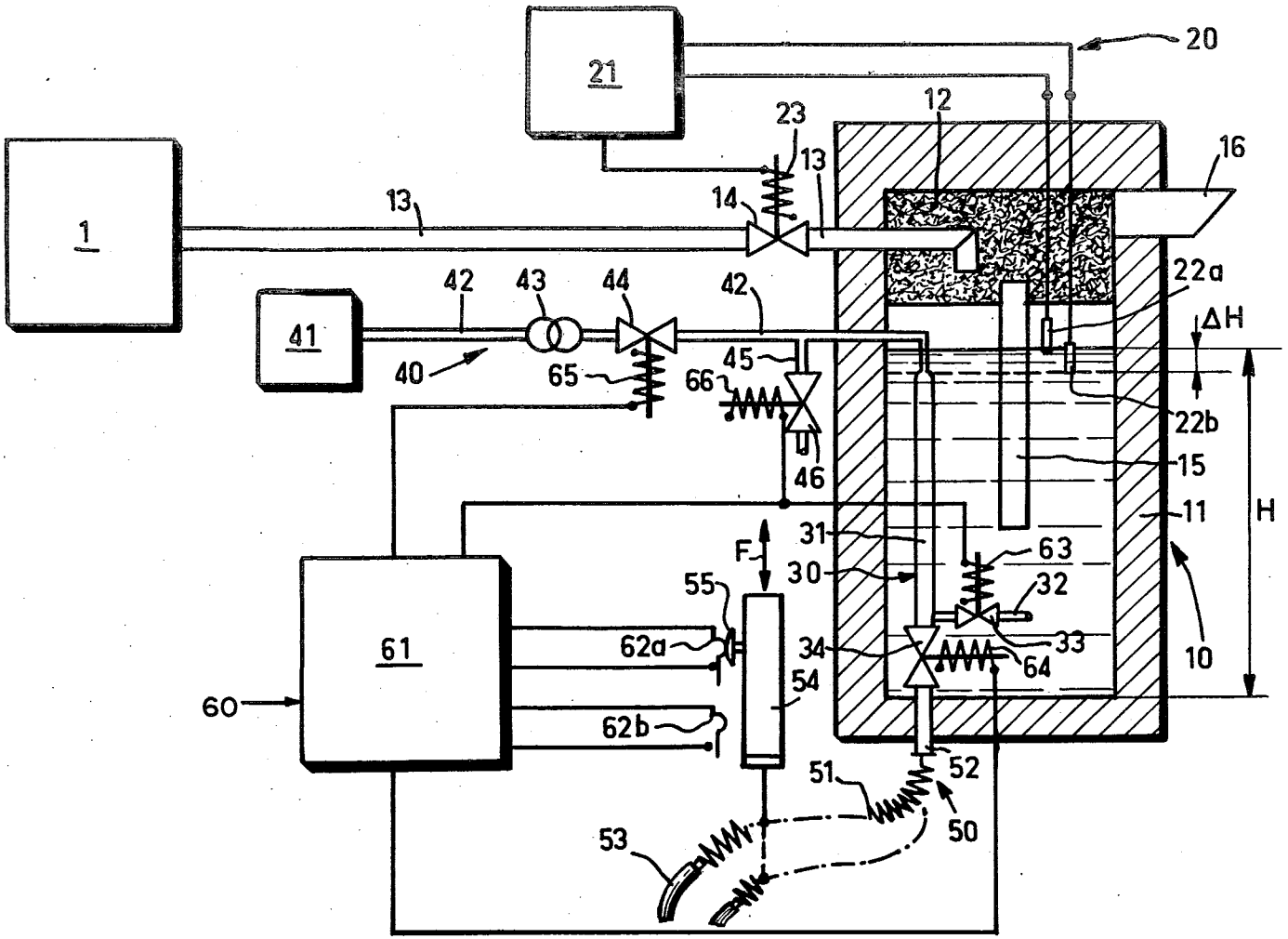
H
ΔH
10
11
15
16
20
22a
22b
12
13
14
23
21
1
42
43
44
45
46
40
41
65
66
30
31
32
33
34
50
51
52
53
54
55
60
61
62a
62b
63
64
F

ARRANGEMENTS FOR THE CONTROLLED INJECTION OF CRYOGENIC FLUID

BACKGROUND OF THE INVENTION

The present invention relates chiefly to an arrangement for injecting, at an adjustable pressure, a predetermined quantity of a cryogenic fluid stored in a storage tank.

Certain applications for cryogenic fluids and in particular the use, in metallurgy, of liquefied inert gases for protecting vats and streams of metal, for purging moulds and for holding them under an inert atmosphere, for producing articles formed form a plurality of metals, for casting articles in series, etc, call for an accurately metered amount of the said fluid to be fed to the point of use, which is generally situated in ambient air, automatically and for a predetermined length of time.

It is an object of the invention to provide an arrangement which enables cryogenic fluids to be supplied under conditions of this kind.

SUMMARY OF THE INVENTION

To achieve this and other objects, the arrangement comprises a container to hold a liquid phase, means for supplying said container from a storage tank via a supply valve, a system for controlling said supply valve which system is sensitive to the level of liquid in said container, at least one metering member which is fed with liquid from said holding container via a filling valve, said member being arranged to receive a predetermined quantity of said liquid and being provided with a discharge valve, means for the forced discharge of said metered quantity of liquid from said metering member, liquid distributing means connected to said discharge valve, and a system for controlling the filling and emptying of said metering member, said control system being responsive to the position of said distributing means.

It can be seen that, by virtue of the various means of which it is made up, an arrangement according to the invention enables a predetermined volume of cryogenic fluid to be injected, and to be injected sequentially and automatically. It is possible, using this arrangement, to maintain a permanent protective layer of liquefied inert gas over a vat of metal by pouring the liquid phase of the said gas onto it and by adjusting the supply of the said liquid phase in such a way as to balance its evaporation. It is also possible to pour, into a mould of given volume, a quantity of liquefied gas required to inertise the mould prior to casting and possibly simultaneously with the casting. Finally, the arrangement enables constant amounts of liquefied gas to be supplied at regular intervals, as is required when casting articles in metal moulds on a casting wheel.

The holding container may comprise a heat-insulated receptacle which is provided, at the top, with a phase separator which is connected to the tank by an inlet pipe for cryogenic fluid and to atmosphere by a vent, the supply valve being formed by an electrical valve mounted in said pipe.

The receptacle thus enables the liquid phase of the cryogenic fluid to be stored temporarily at atmospheric pressure, this phase being virtually free of turbulence.

The control system may comprise an electrical or electronic circuit to supply the electrical valve, said circuit being provided with probes whose level is adjustable and which are situated within the aforesaid receptacle.

A control system of this kind enables the cryogenic liquid in the receptacle to be held at a selected level.

The metering member may comprise at least one tubular, vertical member of which at least part is immersed in the liquid contained in the receptacle, this member being provided with an inlet tube which opens beneath the said liquid and which includes a filling valve.

The tubular member thus receives an amount of cryogenic liquid which is a function of the level of the said liquid in the receptacle.

Other features and advantages of the invention will become apparent from the following description.

BRIEF DESCRIPTION OF THE DRAWING

The accompanying drawing, which is given solely by way of non-limiting example, is a schematic view of a preferred embodiment of an arrangement according to the invention.

DETAILED DESCRIPTION OF THE PREFERRED EMBODIMENT

Referring now to the drawing, the embodiment of the arrangement shown is intended to distribute the liquid phase of a cryogenic fluid which is stored under pressure in a tank. The embodiment includes a container 10 to hold the liquid phase, a system 20 for controlling the supply of the liquid phase to the said container, a metering member 30, discharge means 40 and means 50 for distributing the said liquid phase, and a system 60 for controlling the said metering member.

The holding container 10 comprises, in essence, a receptacle 11 whose walls are heat-insulated and which is provided, at the top, with a phase separator 12 formed by a divided substance such as steel or copper wool. The separator 12 communicates, via a pipe 13 which is provided with an electrical valve 14 which operates on the all-or-nothing principle, with the tank 1 for storing the cryogenic fluid which is, for example, liquefied nitrogen. The cryogenic fluid which enters through the pipe 13 divides in the separator 12 into a liquid phase, which drains through a duct 15 into the receptacle 11, and a vapour phase which escapes to free air through a vent 16.

The system 20 for controlling the supply of cryogenic fluid to the container 10 comprises an electrical or electronic circuit 21 of a known type which supplies an electrical current to the solenoid 23 of the electrical valve 14 in response to information which is supplied to it by means for detecting the level of cryogenic fluid in the receptacle 11. These detecting means are formed by two probes *22a* and *22b* which are for example resistance or vapour-tension probes and which are fitted in the receptacle at two different levels. The probes *22a* and *22b* are also fitted in such a way that their height can be adjusted.

The metering member 30 comprises, in essence, at least one tubular member 31 of circular cross-section which is arranged vertically within the receptacle 11 and which is immersed in the liquid contained in the said receptacle. This tubular member 31, whose diameter is D and whose length L, communicates, at the bottom, with a filling tube 32 which opens into the liquid phase and which is provided with an electrical filling valve 33. The member 31 also has, at its lower end, and electrical discharge valve 34 and communicates, at the top, with means 40 for forced discharge.

The means 40, which are provided for the forced discharge through valve 34 of the liquid contained in the tubular member 31, comprise a source 41 of propellant gas under pressure, preferably an inert gas such as nitrogen, which communicates, via a pipe 42, with the upper part of the tubular member 31. Along the pipe 42 are successively mounted, in the direction of flow of the propellant gas, a pressure reducer 43, an electrical injection valve 44 which operates on the all-or-nothing principle, and a duct 45 provided with an electrical bleed valve 46 which communicates with the ambient atmosphere.

The distributing means 50 are formed by a plurality of flexible heat-insulated tubes 51 which are each connected, at one end, to the electrical valve 34 responsible for discharge from the tubular member 31. These tubes are each provided, at their free ends, with a member 53 for dispensing liquid which is formed, in the case illustrated, by a pouring nozzle. The tubes 51 are connected to an operating mechanism 54. This mechanism may be formed for example by a ram which is movable vertically in two opposing directions, as indicated by the double-headed arrow F, and which is provided with an actuator 55 used to operate electrical switches.

The system 60 which is provided to control the filling and forced emptying of the tubular member 31 comprises, in essence, an electrical or electronic circuit 61 of a known type provided with switches **62*a* and 62*b* which are worked by the actuator 55 of the operating mechanism 54. The system 60 is intended to provide a supply to the solenoids 63, 64, 65 and 66 which are associated respectively with the electrical filling valve 33, the electrical discharge valve 34, the electrical valve 44 for injecting propellant gas into the tubular member 31, and the electrical bleed valve 46 for the said tubular member, depending upon whether the switches 62*a* 62*b* are opened or closed and thus depending on the position of mechanism 54**.

The way in which the arrangement operates is as follows:

When the electrical valve 23 is opened, the cryogenic fluid in the tank 1 flows out, in the form of a biphase mixture, through the pipe 13 and into the separator 12, where the two phases are separated, the gaseous phase escaping through vent 16 while the liquid phase flows into the receptacle 11 through duct 15. The level H of the liquid in the said receptacle 11 depends on the positions at which the probes **22*a* and 22*b*** are set. With the probes in a given position, the value of H is virtually constant, the variations $\Delta H$ in it, which are determined by the vertical distance between the two probes, being small (less than 0.2 cm).

When the electrical filling and bleed valves 33 and 46 are opened as a result of swtich **62*a* closing and when the electrical discharge and injection valve 34 and 44 are closed as a result of switch 62*b* opening (mechanism 54 in the raised position), the tubular member 31** fills with cryogenic liquid following the principle of communicating vesels.

When switch **62*a* is open and switch 62*b* closed (mechanism 54 in the lowered position), electrical valves 33 and 46 are closed and electrical valves 34 and 44 open. The liquid contained in member 31 is then discharged, at a pressure which may be adjusted by means of regulator 43, into the tubes 51 and is injected by the pouring nozzles 53 into the moulds or other cavities to be inertised. A timer forming part of circuit 61 closes the electrical valve 34 when the injection has been completed. The mechanism 54** then returns to the raised position for a new operating cycle.

The volume V of liquid admitted into the tubular member 31 is a function of the height H and may be altered by shifting the probes **22*a* and 22*b*. The variation $\Delta H$ in the level of the cryogenic liquid in the receptacle 11 results in a variation $\Delta V$ equal to $(\pi D^2 \times \Delta H/4)$, i.e. an error of $(\Delta H/L)$. This error is smaller the greater the length L of member 31**.

An arrangement according to the invention considerably facilitates operations which require exact amounts of cryogenic liquid to be used at specific times, such as the coating of articles formed from two or more metals, the inertising of moulds mounted on casting wheels, the intermittent protection of streams of molten metal, etc.

The arrangement is in no way restricted to the embodiment which has been described and illustrated and many modifications could be made thereto without departing from the scope of the invention. Thus, the metering members could for example be formed by a series of members intended to be filled amd emptied successively to enable the cryogenic liquid to be fed out at intervals which may be very short. Similarly, the mechanism for operating the distributing means could be formed by a device other than a ram, such as a carriage for example. It should also be mentioned that the electrical valves 33 and 34 could be positioned outside the receptacle 11, although arranging them inside the receptacle has the advantage that thermal bridges are not created.

We claim:

1. An arrangement for injecting a predetermined quantity of the liquid phase of a cryogenic fluid stored in a storage tank, said arrangement comprising in combination: a container to hold the liquid phase, means including a supply valve connected to said container for supplying cryogenic fluid thereto from said tank, a system connected to the supply valve for controlling said supply valve, which system is sensitive to the level of liquid in said container, at least one metering member having a discharge valve, means including a filling valve communicating with the holding container for feeding liquid from said holding container to said metering member, said member being arranged to receive said predetermined quantity of said liquid, liquid distributing means connected to said discharge valve, and control means for selectively opening and closing said filling valve and said discharge valve to thereby control the filling and emptying of said metering member.

2. An arrangement according to claim 1, wherein said holding container comprises a heat-insulated receptacle having a phase separator, an inlet pipe for cryogenic fluid interconnecting said tank and said phase separator, and means for venting said phase separator to atmosphere, said supply valve comprising an electrical valve mounted in said pipe.

3. An arrangement according to claim 2, wherein said system comprises an electrical circuit for supplying said electrical valve, said circuit being provided with probes whose level is adjustable and which are situated within said receptacle.

4. An arrangement according to claim 1, wherein the said metering member comprises at least one vertical, tubular member at least part of which is arranged for immersion in liquid contained in said receptacle, said member being provided with an inlet tube to open beneath the liquid and which includes said filling valve.

5. An arrangement according to claim 4, which includes means for supplying propellant gas under pressure to the upper end of said tubular member.

6. An arrangement according to claim 5, wherein said tubular member is provided with a bleed valve for the discharge of the propellant gas.

7. An arrangement according to claim 6, wherein said bleed valve is mounted in said pipe.

8. An arrangement according to claim 4, wherein said discharge valve is mounted at the lower end of said tubular member.

9. An arrangement according to claim 4, wherein said filling, injection and discharge valves are electrical valves.

10. An arrangement according to claim 1, wherein said distributing means comprise a heat-insulated tube which is connected, at one end, to said discharge valve.

11. Apparatus for injecting a predetermined quantity of the liquid phase of a cyrogenic fluid stored in a storage tank, the apparatus comprising, in combination:

a container for the liquid phase of the cryogenic fluid;

means including a supply valve interconnecting the container and the storage tank for supplying cryogenic fluid to the container;

operating means for opening and closing the supply valve in response to the liquid level within the container, to admit and arrest the flow of cryogenic fluid thereto;

a generally hollow metering member having a discharge valve and a filling valve communicating with the container;

liquid distributing means connected to the discharge valve of the metering member; and control means connected to the liquid distributing means for selectively operating the discharge and filling valves for the metering member, the operation of the discharge valve discharging a predetermined quantity of liquid from the metering member to the distributing means and the operation of the filling valve replenishing the liquid in said metering member.

12. Apparatus for injecting a predetermined quantity of the liquid phase of a cryogenic fluid stored in a storage tank, the apparatus comprising, in combination:

a container for the liquid phase of the cryogenic fluid;

means including a supply valve interconnecting the container and the storage tank for supplying cryogenic fluid to the container;

operating means connected to the container for opening and closing the supply valve in response to the liquid level within the container, to admit and arrest the flow of cryogenic fluid thereto and thereby maintain said liquid level substantially constant, the operating means having means disposed within the container for sensing said level;

a generally hollow metering member positioned within the container at least partly below the liquid level therein, the metering member having a discharge valve and a filling valve for admitting liquid to the member from the container;

liquid distributing means connected to the discharge valve of the metering member; and control means connected to the liquid distributing means for selectively operating the discharge and filling valves for the metering member, the operation of the discharge valve discharging a predetermined quantity of liquid form the metering member to the distributing means and the operation of the filling valve replenishing the liquid in said metering member.

13. Apparatus for injecting a predetermined quantity of the liquid phase of a cryogenic fluid stored in a storage tank, the apparatus comprising, in combination:

a container for the liquid phase of the cryogenic fluid;

a phase separator disposed within the container for separating said liquid phase from the gaseous phase of the fluid, the container having a vent opening communicating with the separator for venting the gaseous phase to the atmosphere;

means including a supply valve interconnecting the phase separator and the storage tank for supplying cryogenic fluid to the separator;

operating means for opening and closing the supply valve in response to the liquid level within the container, to admit and arrest the flow of cryogenic fluid thereto and thereby maintain said liquid level substantially constant, the operating means having means disposed within the container for sensing said level;

a generally hollow metering member positioned within the container at least partly below the liquid level therein, the metering member having a discharge valve and a filling valve for admitting liquid to the member from the container;

liquid distributing means connected to the discharge valve of the metering member; and control means connected to the liquid distributing means for selectively operating the discharge and filling valves for the metering member, the operation of the discharge valve discharging a predetermined quantity of liquid from the metering member to the distributing means and the operation of the filling valve replenishing the liquid in said metering member.

14. Apparatus for injecting a predetermined quantity of the liquid phase of a cryogenic fluid stored in a storage tank, the apparatus comprising, in combination:

a container for the liquid phase of the cryogenic fluid;

a phase separator disposed within the container for separating said liquid phase from the gaseous phase of the fluid, the container having a vent opening communicating with the separator for venting the gaseous phase to the atmosphere;

means including a supply valve interconnecting the phase separator and the storage tank for supplying cryogenic fluid to the separator;

opeating means connected to the container for opening and closing the supply valve in response to the liquid level within the container, to admit and arrest the flow of cryogenic fluid thereto and thereby maintain said liquid level substantially constant, the operating means having means disposed within the container for sensing said level;

a generally hollow metering member positioned within the container at least partly below the liquid level therein, the metering member having a discharge valve and a filling valve for admitting liquid to the member from the container;

means including an injection valve and a bleed valve for pressurizing the liquid admitted to the metering member;

liquid distributing means connected to the discharge valve of the metering member; and control means connected to the liquid distributing means for selectively operating the discharge and filling valves for the metering member and the injection and bleed valves for the pressurizing means, the operation of the discharge valve discharging a predetermined quantity of liquid from the metering member to the distributing means and the operation of the filling valve replenishing the liquid in said metering member, the operation of the injection and bleed valves maintaining said predetermined quantity of liquid under substantially constant pressure.

* * * * *